US006769762B2

(12) United States Patent
Saito et al.

(10) Patent No.: US 6,769,762 B2
(45) Date of Patent: Aug. 3, 2004

(54) INK JET HEAD SUBSTRATE, AN INK JET HEAD, AN INK JET APPARATUS, AND A METHOD FOR MANUFACTURING AN INK JET RECORDING HEAD

(75) Inventors: Ichiro Saito, Kanagawa-ken (JP); Yoshiyuki Imanaka, Kanagawa-ken (JP); Teruo Ozaki, Kanagawa-ken (JP); Toshimori Miyakoshi, Kanagawa-ken (JP); Muga Mochizuki, Kanagawa-ken (JP); Masahiko Ogawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/212,138

(22) Filed: Aug. 6, 2002

(65) Prior Publication Data

US 2003/0103110 A1 Jun. 5, 2003

Related U.S. Application Data

(63) Continuation of application No. 08/909,626, filed on Aug. 12, 1997.

(30) Foreign Application Priority Data

Aug. 22, 1996 (JP) ..... 8-221402
Aug. 23, 1996 (JP) ..... 8-222152

(51) Int. Cl.[7] ..... B41J 2/05
(52) U.S. Cl. ..... 347/62
(58) Field of Search ..... 252/518.1, 521.5, 252/521.33; 347/62

(56) References Cited

U.S. PATENT DOCUMENTS

| | | | |
|---|---|---|---|
| 4,105,892 A | 8/1978 | Tashiro et al. | 219/216 |
| 4,345,262 A | 8/1982 | Shirato et al. | 347/10 |
| 4,567,493 A | 1/1986 | Ikeda et al. | 347/64 |

(List continued on next page.)

FOREIGN PATENT DOCUMENTS

| | | |
|---|---|---|
| DE | 196 54 568 A1 | 7/1997 |
| EP | 0 630 749 A2 | 12/1994 |
| EP | 0 123 456 A2 | 1/2000 |
| JP | 53-25442 | 3/1978 |
| JP | 56-89578 | 7/1981 |
| JP | 2-6201 B | 4/1982 |
| JP | 57-61582 | 4/1982 |
| JP | 61-100476 | 5/1986 |
| JP | 7-125218 | 5/1995 |

OTHER PUBLICATIONS

Patent Abstracts of Japan, vol. 96, No. 9, Sep. 30, 1996 (with respect to JP 8–118646 of May 14, 1996).

Patent Abstracts of Japan, vol. 12, No. 373 (C–534), Oct. 6, 1988 (with respect to JP 63–125664 of May 28, 1988.

Patent Abstracts of Japan, vol. 12, No. 141 (M–691), Apr. 28, 1988 (with respect to JP 62–259873 of Nov. 12, 1987).

Database WPI, Derwent Publications Ltd., An 75–16606W (with respect to JP 47–78898 of Jul. 30, 1974).

Patent Abstracts of Japan, vol. 6, No. 138 (M–145), Jul. 27, 1982 (with respect to JP 57–61582 of Apr. 14, 1982).

*Primary Examiner*—Michael S Brooke
(74) *Attorney, Agent, or Firm*—Fitzpatrick, Cella, Harper & Scinto

(57) ABSTRACT

A substrate for use of an ink jet recording head is provided with a plurality of heat generating members for generating thermal energy to be utilized for discharging ink. The heat generating members are structured by thin film formed by material represented by $Ta_x$ $Si_y$ $R_z$, which has specific resistance value of 4000 $\mu\Omega$·cm or less, where R is one or more kinds of elements selected from among C, O, N, and x+y+z=100. With the structure thus arranged, the heat generating members make it possible to maintain the change of resistance values within a small amount even when used continuously for a long time, and provide recorded images in high quality with long life and reliability.

4 Claims, 9 Drawing Sheets

U.S. PATENT DOCUMENTS 4,705,697 A 11/1987 Nishiguchi et al. ..... 427/36
4,723,129 A 2/1988 Endo et al. ..... 347/56
4,740,796 A 4/1988 Endo et al. ..... 347/56
4,849,605 A * 7/1989 Nakamori et al. ..... 219/216
4,868,584 A 9/1989 Nikaido et al. ..... 347/202
4,922,269 A 5/1990 Ikeda et al. ..... 347/50
4,980,703 A 12/1990 Sakurai ..... 346/140
5,481,287 A 1/1996 Tachihara ..... 347/62
5,530,467 A 6/1996 Ishigami et al. ..... 347/204
5,831,648 A 11/1998 Mitani et al. ..... 347/62
6,068,369 A 5/2000 Saito et al. ..... 347/62
6,382,775 B1 5/2002 Kubota et al. ..... 347/62

* cited by examiner

INK JET HEAD SUBSTRATE, AN INK JET HEAD, AN INK JET APPARATUS, AND A METHOD FOR MANUFACTURING AN INK JET RECORDING HEAD

This application is a continuation of application Ser. No. 08/909,626, filed Aug. 12, 1997, allowed.

BACKGROUND OF THE INVENTION

1. Field of the Invention

The present invention relates to a substrate that constitutes an ink jet head (hereinafter, simply referred to as an ink jet head) for discharging functional liquid, such as ink, onto recording media including paper sheet, plastic sheet, cloth, commodity, and the like, to record and print characters, symbols, images, and the like, while executing related operations. The invention also relates to an ink jet head formed by use of this substrate, and an ink jet pen that includes an ink reservoir unit to retain ink to be supplied to the ink jet head, as well as an ink jet apparatus having the ink jet head mounted on it.

In this respect, the ink jet pen referred to in the description of the present invention means to include a cartridge mode where the ink jet head and the ink reservoir unit are integrally formed, and a mode where the ink jet head and the ink reservoir unit are formed separately and detachably combined for use. The ink jet pen is structured to be detachably mountable on mounting means of the carriage or the like on the apparatus main body side.

Also, the ink jet recording apparatus referred to in the description of the present invention means to include a mode where it is formed integrally with or separately from a word processor, a computer, or some other information processing apparatus as its output device, and various modes where it operates as a copying system being combined with an information reader or the like, as a facsimile equipment having the functions of receiving and transmitting information, as a textile printing machine, or the like.

2. Related Background Art

An ink jet recording apparatus of the kind is characterized in that it discharges ink from the discharge opening as fine droplets for recording highly precise images at high speeds. Particularly, the ink jet recording apparatus of the type that it uses electrothermal transducing devices as energy generating means for generating energy to be utilized for discharging ink has, in recent years, attracted more attention, because it operates more suitably for recording images in higher precision at higher speeds, while making the recording head and apparatuses smaller, and also, making them more suitable for recording in colors. (For example, refer to the specifications of U.S. Pat. Nos. 4,723,129 and 4,740,796.)

FIG. 1 is a view which shows the general structure of the principal part of the head substrate used for an ink jet recording head described above. FIG. 2 is a cross-sectional view which schematically shows the ink jet recording head substrate 2000 on the part corresponding to the ink flow path, taken along line 2—2 in FIG. 1.

In FIG. 1, the ink jet recording head is provided with a plurality of discharge openings 1001. Also, on the substrate 1004, the electrothermal transducing devices 1002 that generate thermal energy to be utilized for discharging ink from these openings are arranged for each ink flow path 1003, respectively. Each of the electrothermal transducing devices is formed mainly by the heat generating member

1005, the electrode wiring 1006 that supplies electric power to it, and an insulation film 1007 that protects them.

Also, each of the ink flow paths 1003 is formed by a ceiling plate having a plurality of flow path walls 1008, which is adhesively bonded, while its relative positions to the electrothermal transducing devices and others on the substrate 1004 are adjusted by means of image processing or the like. The end of each of the ink flow paths 1003 on the side opposite to the discharge opening 1001 is conductively connected with a common liquid chamber 1009. In this common liquid chamber 1009, ink supplied from an ink tank (not shown) is retained.

Ink supplied to the common liquid chamber 1009 is conducted to each of the ink flow paths 1003 from the chamber, and it is held in the vicinity of each discharge opening by means of meniscus that ink forms in such portion. At this juncture, when the electrothermal transducing devices are selectively driven, ink on the heat activation surface is abruptly heated to bring about film boiling by the utilization of thermal energy thus generated. Ink is discharged by means of its impulsive force at that time.

In FIG. 2, a reference numeral 2001 designates a silicon substrate, and 2002, a heat accumulation layer.

A reference numeral 2003 designates a SiO film that dually functions to accumulate heat; 1004, a heat generating resistive layer; 2005, a metal wiring formed by Al, Al—Si, Al—Cu, or the like; and 2006, a protection layer formed by SiO film, SiN film, or the like. Also, a reference numeral 2007 designates a anti-cavitation film that protects the protection film 2006 from the chemical and physical shock following the heat generation of the heat generating resistive layer 2004, and 2008, the heat activating portion of the heat generating resistive layer 2004.

For the heat generating member used for the recording head of an ink jet recording apparatus, it is required to provide the following characteristics:

(1) As a heat generating member, it should have an excellent capability of responding to heat, thus making it possible to discharge ink instantaneously.

(2) It has a smaller amount of change in resistance values with respect to the high speed and continuous driving, thus presenting a stabilized state of ink foaming.

(3) It has an excellent capability of heat resistance and heat response, as well as a longer life with high reliability.

There is disclosed in Japanese Patent Application Laid-Open No. 7-125218, a structure that uses TaN film for the material of a heat generating member as the one for an ink jet head that satisfies these requirements. The characteristic stability of the TaN film (that is, the ratio of resistance changes, in particular, when recording is repeated for a long time) is closely correlated with the composition of the TaN film. Particularly, the heat generating member formed by tantalum nitride containing $TaN_{0.8hex}$ has a smaller ratio of resistance changes when recording is repeated for a long time, and presents an excellent stability of discharges.

Incidentally, besides the ink jet recording head that uses such heat generating member, there is a thermal printing head that also uses a heat generating member to be directly in contact with a thermo-sensitive sheet or an ink ribbon for recording.

As the heat generating member for such a thermal printing head, there is, for example, the one which is disclosed in the specification of Japanese Patent Application Laid-Open No. 53-25442. This head has an excellent life characteristic as a heat generating member when it operates to generate heat at high temperature. This member is formed by at least one kind of the first element selected from among Ti, Zr, Hf, V, Nb, Ta, W, and Mo; by the second element of N, and by the third element of Si, while being composed by the first element at 5 to 40 atomic %; the second element, at 30 to 60 atomic %; and the third element, at 30 to 60 atomic %. Or as disclosed in the specification of Japanese Patent Application Laid-Open No. 61-100476, there is one heat generating member having highly thermal stability and excellent printing quality, which is formed by an alloy of tantalum, high fusion point metal (such as Ti, Zr, Hf, V, Nb, Cr, Mo, or W) and nitrogen. Further, as disclosed in the specification of Japanese Patent Application Laid-Open No. 56-89578, there is a thermal head that uses a heat generating member having an excellent acid-proof capability and stability of resistance values, which contains the metal that forms nitride, silicon, and nitrogen. Also, as disclosed in the specification of Japanese Patent Publication No. 2-6201, there is a thermal head using Ta—Si—O thin film as the heat generating member, which has durability against high speed recording as well as against the use that requires a long life of the member.

At present, however, $HfB_2$, TaN, TaAl or TaSi is used as material for the heat generating member for an ink jet recording head. Here, in general, none of the heat generating members adopted for the thermal printing head described above is practically used for the ink jet recording head.

This is due to the fact that whereas an electric power of approximately 1 W is applied to the heat generating member of the thermal printing head per 1 msec, an electric power of approximately 3 to 4 W is applied to the heat generating member of the ink jet head per 7 $\mu$sec, for instance, which is larger than the electric power given to the thermal printing head by several times. Therefore, the heat generating member of the ink jet head tends to receive more thermal stress than the thermal printing head in a shorter period of time.

Consequently, for such heat generating member, it is necessary to consider the discharge and method for driving the member genuine to an ink jet head, which are different from the method adopted for the thermal printing head. Thus, the design consideration should be given to the heat generating member (with respect to the film thickness, heater size, configuration, and the like) optimized for use of the ink jet head. It is impossible to adopt a heat generating member currently in use for a thermal printing head for the ink jet head as it is.

Now, for the ink jet recording apparatus, there has been demand, in recent years, on the enhancement of its functions with respect to the production of higher image quality and higher recording speeds as described earlier. Here, in order to make the image quality higher, there is a method of improving the image quality by making the size of each heater (heat generating member) smaller so that the discharge amount is reduced per dot to obtain small dots as intended.

Also, for the performance of a higher recording, there is a method of increasing driving frequency as required by making pulses shorter still than conventionally practicable.

Nevertheless, in order to drive the heater at higher frequency in a structure where the heater size is made smaller for the purpose of obtaining higher image quality as described above, the sheet resistance value thereof should be made larger. FIG. 3A is a graph which illustrates the relations between various driving conditions depending on the difference in heater sizes.

FIG. 3A shows changes of the sheet resistance value of the heat generating member and electric current value with respect to the pulse width when the heater size changes from larger (A) to smaller one (B) at a constant driving voltage. Likewise, FIG. 3B is a graph which illustrates the relations between the sheet resistance value of the heat generating member and the electric current value with respect to the driving voltage when the heater size changes at a constant width of driving pulse.

In other words, when the heater size is made smaller, it is necessary to increase the sheet resistance value in order to drive the member under the same condition as conventionally practicable. Also, with energy requirement in view, it is possible to reduce the electric current value when the sheet resistance value is made larger, and the member is driven at a higher driving voltage, hence attaining energy saving. Such effect becomes significant particularly when the structure is such that a plurality of heat generating members are arranged.

As described earlier, however, the specific resistance value of the heat generating member formed by $HfB_2$, TaN, TaAl, or TaSi, among some others, used for the ink jet recording head currently in use is approximately 200 to 300 $\mu\Omega\cdot$cm. Therefore, in consideration of the stability of heat generating members being produced, the stabilized characteristics of discharges, and the like, the limit of the sheet resistance value is 150 $\Omega/\square$ if the limit of the film thickness of the heat generating member is considered to be 200 Å.

Therefore, if it is intended to obtain a larger value of sheet resistance than such limit, it becomes difficult to use any one of the heat generating members described above.

In the meantime, the heat generating member adopted for the thermal printing head described above makes it possible to increase the sheet resistance value. However, it is impossible to adopt such member for the ink jet head that requires the attainment of the particular heat response and high speed performance of recording as described above.

Further, for an ink jet recording apparatus, the power source capacitance and the semiconductor device should withstand pressure. As a result, there is automatically limit to the driving voltage. It is currently considered that the upper limit thereof is approximately 30 V. In order to drive the apparatus at a driving voltage less than this limit, it is necessary to set the specific resistance value of the heat generating member at 4,000 $\mu\Omega\cdot$cm or less. The specific resistance value of the heat generating member used for the thermal printing head described above is generally beyond 4,000 $\mu\Omega\cdot$cm eventually.

In accordance with the conventional art, therefore, there has been no heat generating member that may be adoptable for use of an ink jet recording head, which should be provided with an excellent response by short pulse driving, while presenting a high sheet resistance value.

Further, along with more precise images to be recorded, the size of heaters should be made smaller for recording by means of smaller droplets. As a result, as far as the conventional heat generating member is used, the electric current value is increased, leading to a problem related to heat generation after all.

SUMMARY OF THE INVENTION

Therefore, it is the main objective of the present invention to provide a substrate for use of an ink jet recording head having heat generating members, each being capable of solving all the problems described above, which are inherent in the conventional heat generating members of the ink jet recording head, and also, being capable of obtaining recorded images in high quality for a long time, as well as to provide an ink jet recording head and an ink jet recording apparatus.

It is another object of the invention to provide a substrate for use of an ink jet recording head having heat generating members, each being capable of discharging stably even when dots are made smaller for images to be recorded in high precision at higher speeds, and also, to provide an ink jet recording head, as well as an ink jet recording apparatus.

It is still another object of the invention to provide an ink jet pen including an ink reservoir unit for retaining ink to be supplied to such excellent ink jet recording head as described above, and also, to provide an ink jet recording apparatus provided with such ink jet recording head.

It is a further object of the invention to provide an ink jet recording head having an enhanced interlayer contactness for an ink jet recording head provided with a laminated structure of heat accumulation layer/heat generating resistance layer/protection layer having the heat generating resistance layer between them.

In order to achieve these objectives, the present invention is designed to provide a substrate for use of an ink jet recording head, an ink jet recording head, an ink jet recording apparatus, and a method for manufacturing them as given below.

In other words, a substrate for use of an ink jet recording head provided with a plurality of heat generating members for generating thermal energy to be utilized for discharging ink, wherein the heat generating members are structured by thin film formed by material represented by $Ta_x$ $Si_y$ $R_z$ having specific resistance value of 4000 $\mu\Omega\cdot$cm or less, where R: one or more kinds of elements selected from among C, O, N, and x+y+z=100.

Also, an ink jet recording head provided with ink discharge openings for discharging ink, a plurality of heat generating members for generating thermal energy to be utilized for discharging ink, and ink flow paths including the heat generating members therein, at the same time being conductively connected with the ink discharge openings, wherein the heat generating members are structured by thin film formed by material represented by $Ta_x$ $Si_y$ $R_z$ having specific resistance value of 4000 $\mu\Omega\cdot$cm or less.

Also, an ink jet recording apparatus provided with an ink jet recording head having ink discharge openings for discharging ink, a plurality of heat generating members for generating thermal energy to be utilized for discharging ink, and ink flow paths including the heat generating members therein, at the same time being conductively connected with the ink discharge openings, and carrier means for carrying a recording medium receiving ink to be discharged from the recording head of the ink jet recording head, wherein the heat generating members are structured by thin film formed by material represented by $Ta_x$ $Si_y$ $R_z$ having specific resistance value of 4000 $\mu\Omega\cdot$cm or less.

Also, a method for manufacturing an ink jet recording head provided with ink discharge openings for discharging ink, a plurality of heat generating members for generating thermal energy to be utilized for discharging ink, and ink flow paths including the heat generating members therein, at the same time being conductively connected with the ink discharge openings, wherein the heat generating members use an alloy target formed by Ta—Si, and by means of reactive sputtering system these members are formed in the mixed gas atmosphere having at least nitrogen gas, oxygen gas, carbon gas, and argon gas.

Also, a method for manufacturing an ink jet recording head provided with ink discharge openings for discharging ink, a plurality of heat generating members for generating thermal energy to be utilized for discharging ink, and ink flow paths including the heat generating members therein, at the same time being conductively connected with the ink discharge openings, wherein the heat generating members use two kinds of targets formed by Ta and Si, and by means of two-dimensional co-sputtering system these members are formed in the mixed gas atmosphere having at least nitrogen gas, oxygen gas, carbon gas, and argon gas.

With the provision of an ink jet recording head by means of structure and method of manufacture of the present invention, the heat generating members described above make it possible to obtain a desired durability even when the size of heaters is made smaller, while the heaters are driven by shorter pulses for a longer period of time, and demonstrate high energy efficiency in order to suppress heat generation for energy saving. At the same time, recorded images are provided in high quality.

Also, the present invention is not limited to only use of ink for ink jet recording head. The invention is also applicable to liquid for an ink jet recording head, which can be discharged by use of the heat generating members described above.

DETAILED DESCRIPTION OF THE PREFERRED EMBODIMENTS

Hereinafter, the detailed description will be made of a number of embodiments in accordance with the present invention. However, the present invention is not necessarily limited only to each of the embodiments given below. It goes without saying that any modes may be adaptable if only such modes can be arranged to achieve the objectives of the present invention.

Now, with reference to the accompanying drawings, the present invention will be described in detail. However, the present invention is not necessarily limited only to each of the embodiments given below. It should be good enough if only the mode that may be adopted is capable of achieving the objectives of the present invention.

Figure 1:
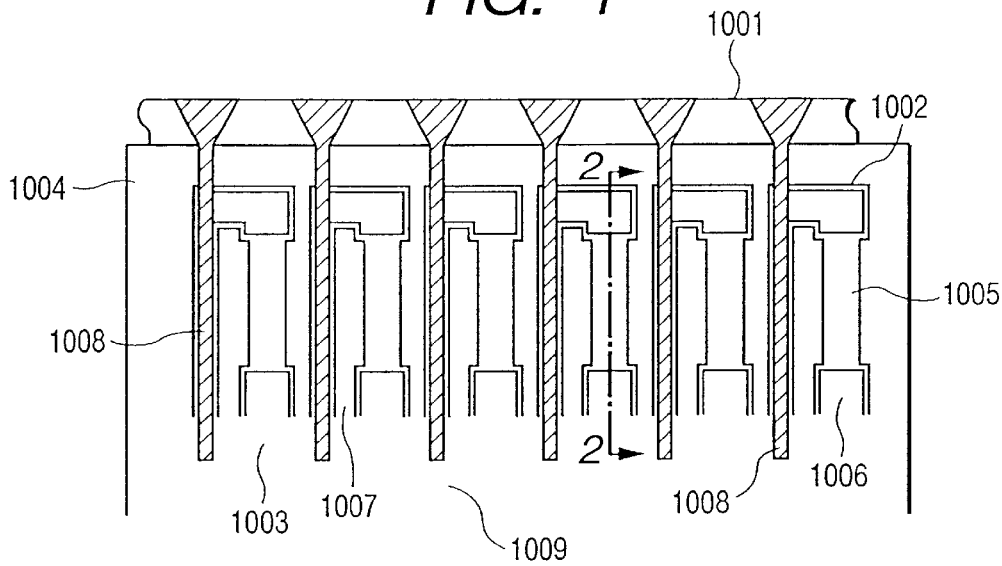
FIG. 1 is a plan view which schematically shows the substrate of an ink jet head in accordance with the present invention.
Figure 2:
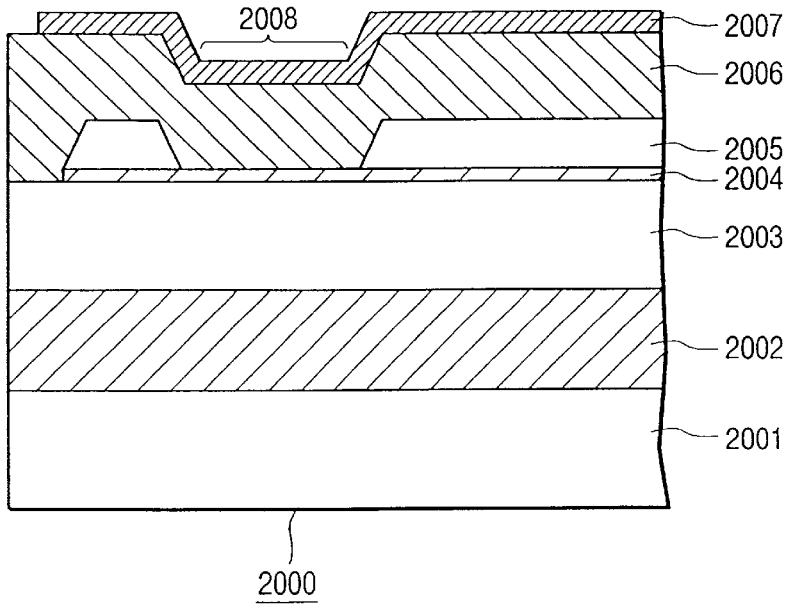
FIG. 2 is a cross-sectional view which shows the substrate represented in FIG. 1, cut vertically along the 2—2 one dot chain line in it.
Figure 3B:
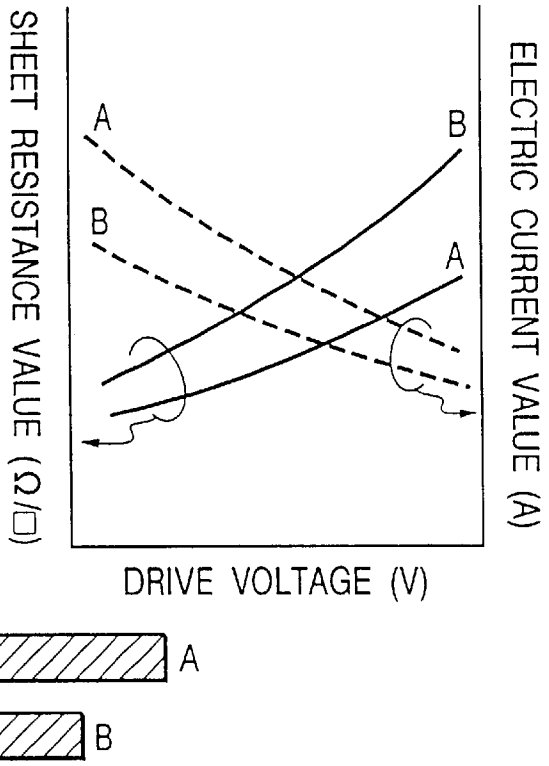
FIGS. 3A and 3B are graphs which illustrate each of the driving conditions depending on the difference in heater sizes.
Figure 3A:
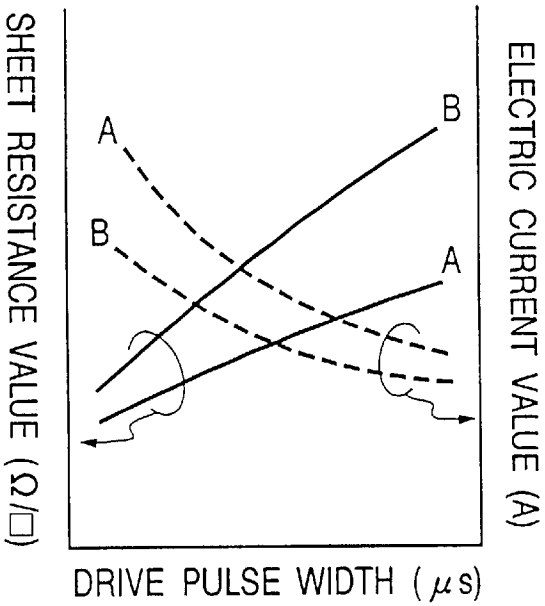

FIG. 1 is a plan view which schematically shows the principle part of the substrate of a heat generating member that foams ink for an ink jet head in accordance with a first embodiment of the present invention. FIG. 2 is a cross-sectional view which schematically shows the portion of the substrate cut perpendicular to the surface thereof along the 2—2 one dot chain line in FIG. 1.

Figure 4:
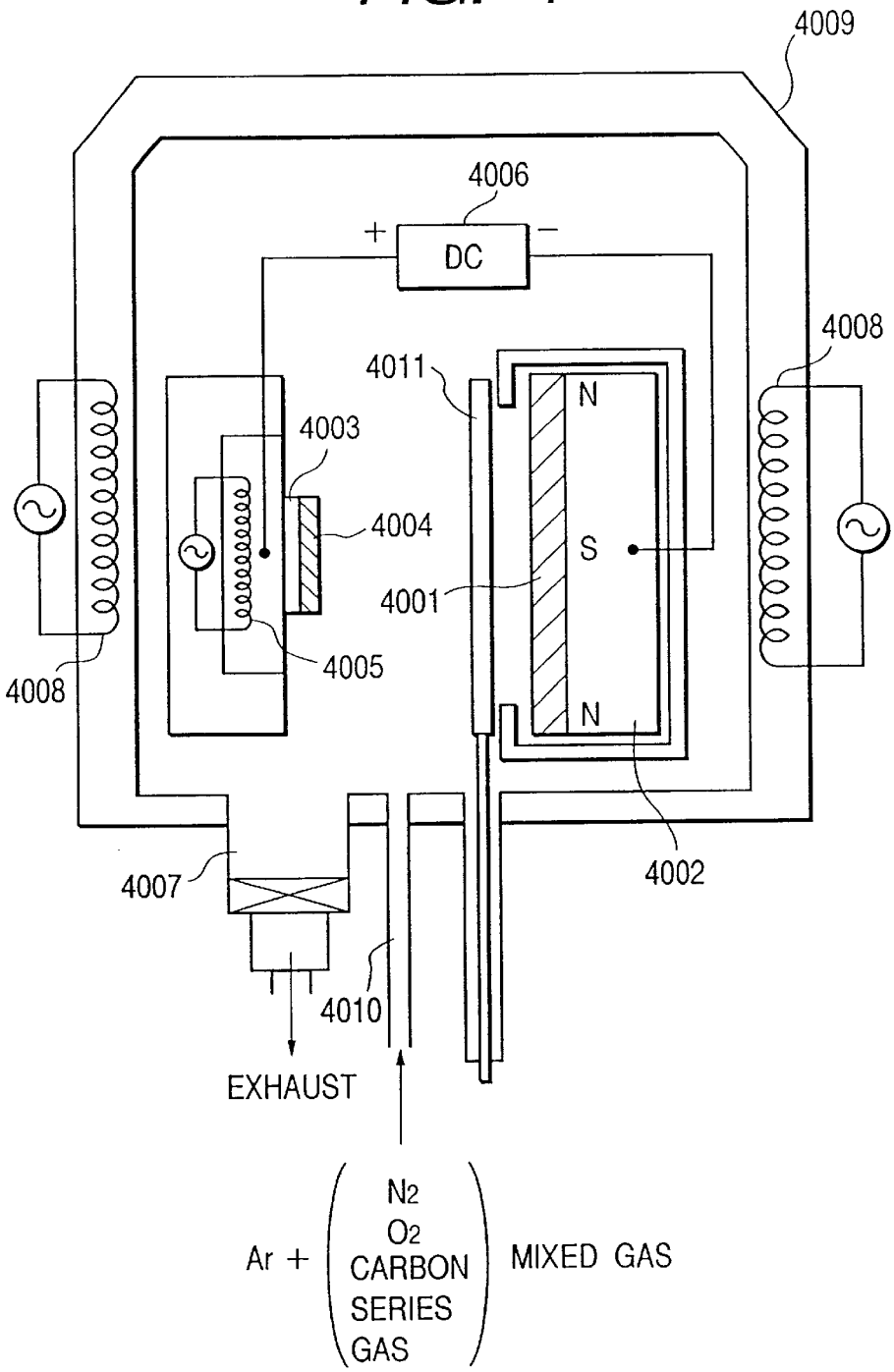
FIG. 4 is a view which shows a film formation system to film each of the layers of the substrate of the ink jet recording head of the present invention.

In accordance with the present embodiment, the heat generating member 2004 of the present invention can be produced by the application of various film formation methods. In general, this member is formed by means of magnetron sputtering method using a high frequency (RF) power-supply as power source or using direct current (DC) power source. FIG. 4 is a view which schematically shows the outline of the sputtering system that films the heat generating member 2004 described above. In FIG. 4, a reference numeral 4001 designates a target produced with given composition in advance; 4002, a flat magnet; 4011, a shutter that controls the film formation with respect to the substrate; 4003, a substrate holder; 4004, a substrate; and 4006 a power source to be connected with the target 4001 and the substrate holder 4003 as well.

Further, in FIG. 4, a reference numeral 4008 designates the outer heater arranged to surround the outer circumferential wall of the film formation chamber 4009. The outer heater 4008 is used for adjusting the atmospheric temperature of the film formation chamber 4009. On the reserve side of the substrate holder 4003, the inner heater 4005 is arranged to control the temperature of the substrate. It is preferable to control the temperature of the substrate 4004 in combination with the outer heater 4008.

Using the system shown in FIG. 4 the film formation is executed as given below. At first, using the exhaust pump 4007 the film formation chamber is evacuated down to $1\times10^{-5}$ to $1\times10^{-6}$ Pa. Then, mixed gas of oxygen gas and carbon gas is induced into the film formation chamber 4009 from the gas induction opening through the massflow controller (not shown) in accordance with argon gas and nitrogen gas or the heat generating member to be formed. At this juncture, the inner heater 4005 and the outer heater 4008 are adjusted so that the temperature of the substrate and the atmospheric temperature are made to be given temperatures. Then, power is applied to the target 4001 from the power source 4006 to perform sputtering discharges. The shutter 4011 is adjusted. Thus, thin film is formed on the substrate 4004.

This film formation for the heat generating member described above has been described in accordance with a formation method that adopts reactive sputtering, while using an alloy target formed by Ta—Si. However, the present invention is not necessarily limited to such formation method. It may be possible to perform the film formation by means of a two-dimensional co-sputtering system where power is applied from the power source to the two bases having Ta target and Si target separately connected for processing. In this case, it is possible to control the power to be applied to each of the targets individually.

Further, it may be possible to perform film formation using Ta—Si—N, Ta—Si—O, Ta—Si—C or an alloy target formed by the mixture thereof with a sputtering system using argon gas (or depending on cases, with the reactive sputtering system that induces nitrogen gas, oxygen gas, and carbon gas).

In accordance with the present embodiment, the system shown in FIG. 4 is adopted for use, and the heat generating film is produced by the film formation method described above under various conditions thereof.

(Embodiment 1)

Hereinafter, the description will be made specifically of a first embodiment in accordance with the present invention.

In FIG. 2, the heat accumulation layer 2002 is formed in the film thickness of 1.8 $\mu$m on the silicon substrate 2001 by means of thermal oxidation as partly described earlier. Further, as an interlayer film 2003 that dually serves as the heat accumulation layer, the $SiO_2$ film is formed by plasma CVD method in the film thickness of 1.2 $\mu$m. Then, as a heat generating resistance layer 2004, the Ta—Si—N film is formed at 1000 Å by two-dimensional co-sputtering system using two targets.

At this juncture, the gas flow rate is: Ar gas is at 45 sccm, $N_2$ gas, 15 sccm, and the partial pressure ratio of nitrogen gas, 25%. The power applied to the targets is: 150 W for the Si target, and 500 W for the Ta target, while the atmospheric temperature being set at 200° C. with the substrate temperature being 200° C.

Further, as a metallic wiring 2005 that heats the heat generating layer 2004 on the heat activating portion 2008, the Al film is formed at 5500 Å by means of sputtering system.

Then, these are photolithographed for the patterning formation in order to produce the heat activating portion 2008 of 15 $\mu$m×40 $\mu$m after removing the Al layer. As the protection film 2006, SiN film is formed in the film thickness of 1 $\mu$m by means of plasma CVD method. Lastly, as an anti-cavitation layer 2007, the Ta film is formed at 2000 Å by means of the sputtering system in order to obtain the substrate of the present invention. The sheet resistance value of the heat generating resistance layer configured as above is 270 Ω/□.

COMPARATIVE EXAMPLE 1

A substrate is obtained as a comparative example 1 by producing it as in the embodiment 1 with the exception of the modification which is made with respect to the heat generating resistance layer 2004 as given below. In other words, the $TaN_{0.8}$ film is formed at 1000 Å by means of the reactive sputtering system using Ta target. At this juncture, the gas flow rate is: Ar gas is at 48 sccm, $N_2$ gas, 12 sccm, and the partial pressure of the nitrogen gas, 20%. The power applied to the Ta target is 500 W. The atmospheric temperature is 200° C., and the substrate temperature is 200° C. The sheet resistance value of the heat generating resistance layer is 25 Ω/□.

<Evaluation 1>

Using substrates produced as the embodiment 1 and the comparative exsample 1 as described above a foaming voltage Vth is obtained for discharging ink.

Then, with respect to this Vth, the electric current value is measured when driven by the driving pulse whose width is 2 $\mu$sec at the driving voltage of 1.2 Vth (1.2 times the foaming voltage).

In other words, in accordance with the embodiment 1, the Vth is equal to 24V and the electric current value is 35 mA. Against this, the comparative example 1 is: the Vth is equal to 9.9V and the electric current value is 120 mA. From the result of the comparison between the embodiment 1 of the present invention and the substrate of the example 1, it is clear that the electric current value of the former is approximately ⅓ of the latter. For the actual mode of the head, a plurality of heat generating members are driven at a time. Therefore, the present embodiment dissipates electric power in an amount much less than the comparative example 1. It is readily understandable, therefore, that the present embodiment produces favorable effect on the energy saving.

Further, the heat generating member is driven by the application of breaking pulse under the following condition for the evaluation of durability against thermal stress:

Driving frequency: 10 kHz; the width of driving pulse: 2 μsec.

Driving voltage: foaming voltage×1.3

As a result, whereas the comparative example 1 is broken at the pulse of $6.0\times10^7$, the embodiment 1 is not broken up to the pulse of $5.0\times10^9$.

As described above, it is clear that the substrate of the present embodiment sufficiently withstands the driving by shorter pulses.

(Embodiment 2)

The substrate 2000 shown in FIG. 1 is obtained by producing it in the same manner as the embodiment 1 with the exception of the heat generating resistance layer 2004 which is modified as given below. In other words, for the gas to be induced at the time of film formation, the nitrogen gas applied to the embodiment 1 is replaced with the oxygen gas, and then, by means of the reactive sputtering system, the Ta—Si—O film is formed at 1000 Å. At this juncture, the gas flow rate is: Ar gas is at 45 sccm, oxygen gas, 15 sccm, and partial pressure of the oxygen gas, 25%. The power applied to the target is: Si target is at 150 W, Ta target, 520 W. The atmospheric temperature is 200° C., and the substrate temperature is 200° C. The sheet resistance value is 290 Ω/□.

<Evaluation 2>

In the same manner as the evaluation 1, the substrate produced in accordance with the embodiment 2 is evaluated. As a result, the Vth is equal to 25V and the electric current value is 36 mA for the substrate of the embodiment 2.

Also, in accordance with the durability evaluation against thermal stress using the breaking pulse, the substrate is not broken up to the pulse of $6.0\times10^9$.

Here, as the result of the evaluation 1, it is also understandable that the substrate of the embodiment 2 has a small value of electric current, and that it produces excellent effect on the energy dissipation.

Also, this substrate has an excellent durability even when it is driven at shorter driving pulses.

(Embodiment 3)

The substrate 2000 shown in FIG. 1 is obtained by producing it in the same manner as the embodiment 1 with the exception of the heat generating resistance layer 2004 which is modified as given below. In other words, for the gas to be induced at the time of film formation, the nitrogen gas applied to the embodiment 1 is replaced with the methane ($CH_4$) gas, and then, by means of the reactive sputtering system, the Ta—Si—O film is formed at 1000 Å. At this juncture, the gas flow rate is: Ar gas is at 48 sccm, $CH_4$ gas, 15 sccm, and partial pressure of the $CH_4$ gas, 25%. The power applied to the target is: Si target is at 150 W, Ta target, 500 W. The atmospheric temperature is 200° C., and the substrate temperature is 200° C.

<Evaluation 3>

In the same manner as the evaluation 1, the substrate produced in accordance with the embodiment 3 is evaluated. As a result, the Vth is equal to 22V and the electric current value is 41 mA for the substrate of the embodiment 3.

Also, in accordance with the durability evaluation against thermal stress using the breaking pulse, the substrate is not broken up to the pulse of $6.0\times10^9$.

As the result of the evaluation 1, it is also understandable that the substrate of the embodiment 3 has a small value of electric current, and that it produces excellent effect on the energy dissipation.

Also, this substrate has an excellent durability even when it is driven at shorter driving pulses.

(Embodiment 4)

The substrate 2000 shown in FIG. 1 is obtained by producing it in the same manner as the embodiment 1 with the exception of the heat generating resistance layer 2004 which is modified as given below. In other words, for the gas to be induced at the time of film formation, the nitrogen gas applied to the embodiment 1 is replaced with the mixed gas of nitrogen gas and oxygen gas, and then, by means of the reactive sputtering system, the Ta—Si—O—N film is formed at 1000 Å. At this juncture, the gas flow rate is: Ar gas is at 48 sccm, the mixed gas, 12 sccm (oxygen gas, 5 sccm and nitrogen gas, 7 sccm), and partial pressure of the mixed gas, 20%. The power applied to the target is: Si target is at 150 W, Ta target, 500 W. The atmospheric temperature is 200° C., and the substrate temperature is 200° C.

<Evaluation 4>

In the same manner as the evaluation 1, the substrate produced in accordance with the embodiment 4 is evaluated. As a result, the Vth is equal to 23V and the electric current value is 39 mA for the substrate of the embodiment 4.

Also, in accordance with the durability evaluation against thermal stress using the breaking pulse, the substrate is not broken up to the pulse of $5.0\times10^9$.

As the result of the evaluation 1, it is also understandable that the substrate of the embodiment 4 has a small value of electric current, and that it produces excellent effect on the energy dissipation.

Also, this substrate has an excellent durability even when it is driven at shorter driving pulses.

<Evaluation on the Solid State of Film>

Then, in order to evaluate the solid state of film, several kinds of Ta—Si—N films are produced using the system shown in FIG. 4 in the same manner and the same method as in the embodiments described above.

At first, a thermal oxidation film is formed on a monocrystal silicon wafer, and set on the substrate holder 4003 in the film formation chamber 4009 shown in FIG. 4 (substrate 4004). Subsequently, the film formation chamber 4009 is evacuated by means of the exhaust pump 4007 down to $8\times10^{-6}$ Pa.

After that, the mixed gas of argon gas and nitrogen gas is induced into the film formation chamber 4009 through the gas induction opening. The gas pressure in the film formation chamber 4009 is adjusted to a given pressure. Then, depending on each case, the partial pressure of nitrogen gas in the mixed gas described above is modified accordingly to form each kind of heat generating member by performing film formation under the following condition in accordance with the film formation method described above.

[Condition of Film Formation]

Substrate temperature: 200° C.

Atmospheric temperature of gas in the film formation chamber: 200° C.

Pressure of mixed gas in the film formation chamber: 0.3 Pa

The X-ray diffraction measurement is conducted for the Ta—Si—N film of the heat generating member formed on the substrate 4004 as described above, thus the structural analysis being executed. As a result, it becomes clear that no specific diffraction peak appears even when the partial pressure of nitrogen gas changes, and that each of these films has a structure close to that of amorphous.

Figure 5:
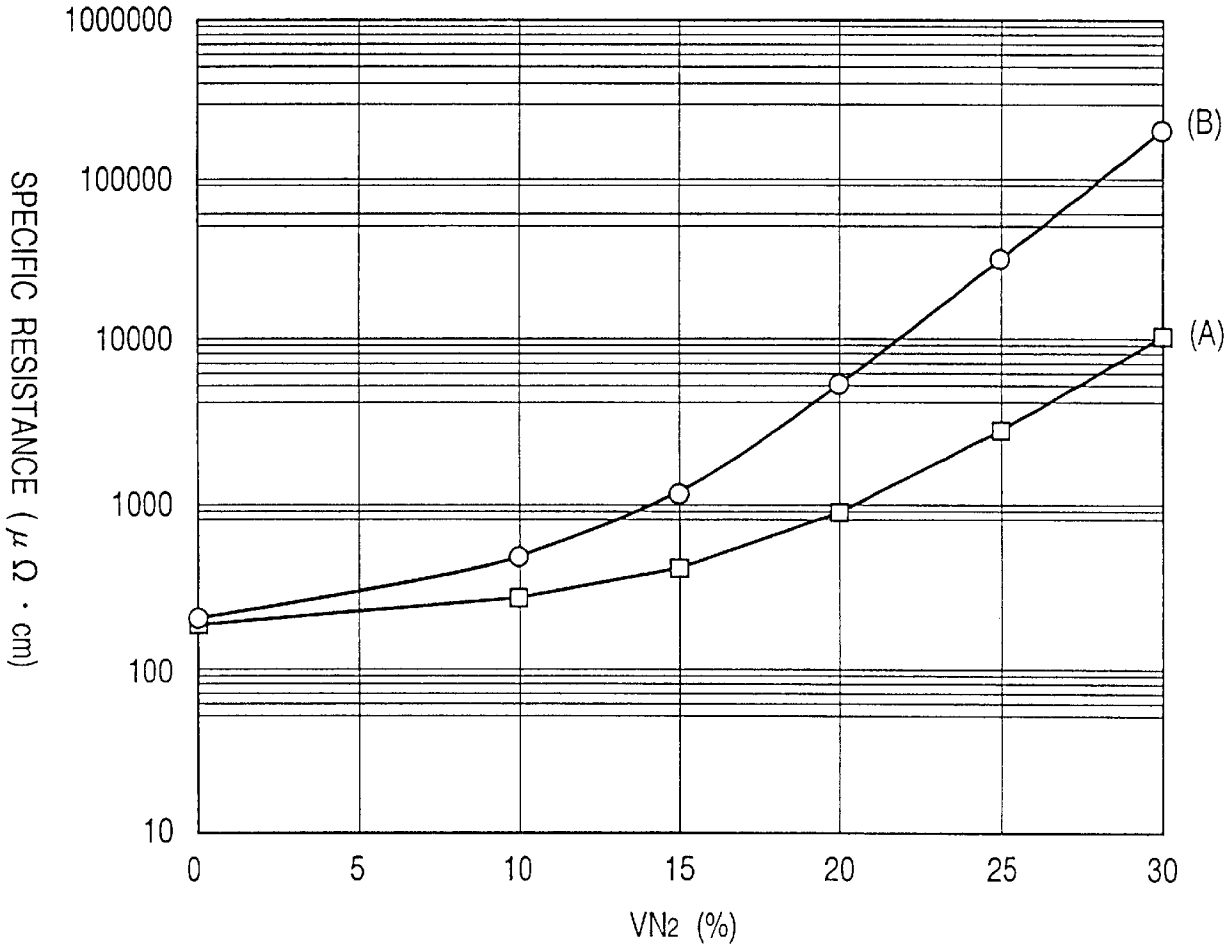
FIG. 5 is a view which shows the specific resistance values with respect to the partial nitrogen pressure of the resistance layer that forms the Ta—Si—N heat generating member.

Then, by means of the four probe method, the sheet resistance value of each of the films described above is measured to obtain the specific resistance value thereof. FIG. 5 is a view which shows the characteristic curves thereof at A and B. As at A in FIG. 5, it is understandable that the specific resistance value changes continuously as the partial pressure of nitrogen increases. Also, as at B in FIG. 5, when the power applied to the target Si increases more than the target Ta, the partial pressure of nitrogen and the specific resistance value increase likewise. However, the changes of the specific resistance value become greater. Conceivably, this is due to the fact that the amount of Si increases in the film. Therefore, it suggests that a desired specific resistance value is obtainable by arbitrarily setting the powers to be applied to the Ta and Si targets and the partial pressure of nitrogen.

Subsequently, the composition analyses are executed by carrying out the RBS (Rutherford back scattering) analysis for each of the films described above.

Figure 6:
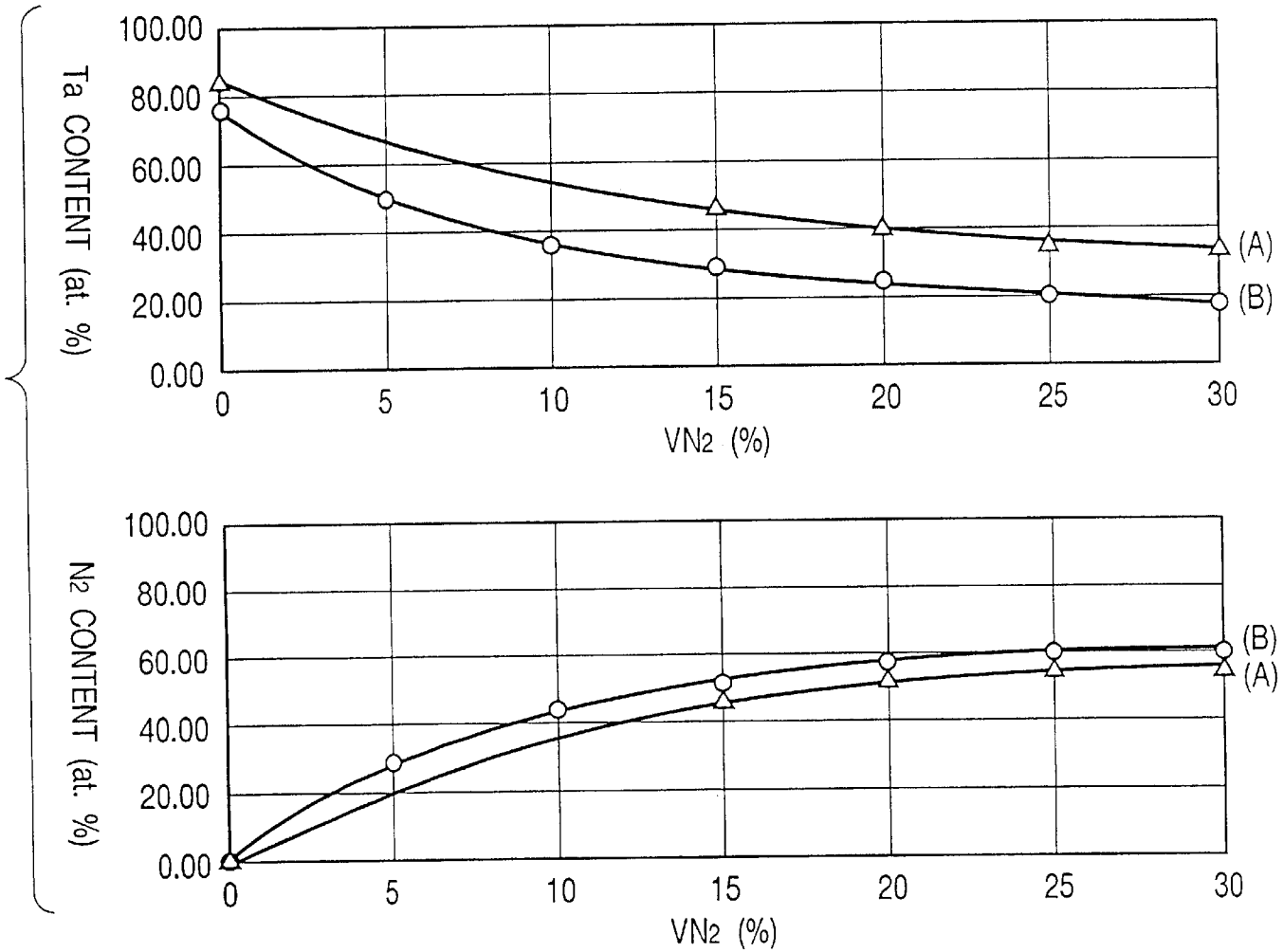
FIG. 6 is a view which shows the values of film composition with respect to the partial nitrogen pressure of the resistance layer that forms the Ta—Si—N heat generating member.

FIG. 6 shows the results of such analyses. The curb A in FIG. 6 represents the film composition corresponding to the curb at A in FIG. 5. The curb B in FIG. 6 represents the film composition corresponding to the curb at B in FIG. 5, respectively. Also, from those curves represented in FIG. 5 and FIG. 6, it becomes clear that the specific resistance values and film compositions are correlated.

<Evaluation on Ink Jet Characteristics>

Further, in accordance with the embodiments 5 to 11, ink jet recording heads are produced in order to evaluate the characteristics of the substrate as the heat generating member for use of each ink jet recording head. Here, plural kinds of Ta—Si—N films are formed using the system shown in FIG. 4 under the respective film formation conditions in the same manner and film formation method as the previous embodiments described above. Then, the characteristics of each head are evaluated.

(Embodiment 5)

For the sample substrate, which is evaluated with respect to the ink jet characteristics in accordance with the present embodiment, the Si substrate or the Si substrate on which driving IC has already been assembled is used.

For the Si substrate, the $SiO_2$ heat accumulation layer 2002 (see FIG. 2) is formed in the film thickness of 1.8 $\mu$m by means of thermal oxidation, sputtering, CVD, or the like. For the Si substrate having the IC assembled thereon, the $SiO_2$ heat accumulation layer is also formed likewise during the manufacturing process thereof.

Then, the $SiO_2$ interlayer insulation film 2003 is formed in the film thickness of 1.2 $\mu$m by means of sputtering, CVD, or the like. Subsequently, by the two-dimensional sputtering method using Ta and Si targets, the heat generating resistance layer 2004 is formed under conditions shown in Table 1 below. The power applied to target is: Ta-400 W, and Si-300 W, and the gas flow rate is conditioned as shown in Table 1. The substrate temperature is set at 200° C.

TABLE 1

| | Heat generating resistance layer | Target | Gas flow rate Ar | Gas flow rate N2 | VN2 (%) | Breaking voltage ratio Kb | Changing ratio of resistance values ΔR/R (%) | Printing durability 10000 shts. 5000 shts | Printing durability 10000 shts. 10000 shts | Specific resistance value ($\mu\Omega \cdot$ cm) |
|---|---|---|---|---|---|---|---|---|---|---|
| Embodiment 5 | Ta35-Si22-N43 | Ta, Si | 54 | 6 | 10 | 1.8 | +1.2 | ○ | ○ | 650 |
| Embodiment 6 | Ta30-Si23-N47 | Ta, Si | 52.2 | 7.8 | 13 | 1.8 | +1.0 | ○ | ○ | 800 |
| Embodiment 7 | Ta29-Si21-N50 | Ta, Si | 51 | 9 | 15 | 1.75 | +2.0 | ○ | ○ | 1000 |
| Embodiment 8 | Ta70-Si5.5-N24.5 | Ta, Si | 57 | 3 | 5 | 1.8 | +3.0 | ○ | ○ | 330 |
| Embodiment 9 | Ta30-Si20-N50 | Ta80-Si20 | 51.6 | 8.4 | 14 | 1.8 | +1.1 | ○ | ○ | 750 |
| Embodiment 10 | Ta35-Si19-N46 | Ta80-Si20 | 52.8 | 7.2 | 12 | 1.8 | +1.5 | ○ | ○ | 700 |
| Embodiment 11 | Ta28-Si20-N52 | Ta80-Si20 | 49.8 | 10.2 | 17 | 1.75 | +2.2 | ○ | ○ | 1100 |
| Comparative example 2 | Ta10-Si40-N50 | Ta, Si | 51 | 9 | 15 | 1.2 | broken | X | X | 45000 |
| Comparative example 3 | Ta15-Si30-N55 | Ta, Si | 48 | 12 | 20 | 1.25 | broken | X | X | 33000 |
| Comparative example 4 | Ta86-Si5-N9 | Ta, Si | 59 | 1 | 2 | 1.7 | +41 | ○ | X | 270 |
| Comparative example 5 | Ta32-Si6-N62 | Ta, Si | 42 | 18 | 30 | 1.2 | broken | X | X | 9800 |

Note) ○: good
X: not good

As the electrode wiring, Al film is formed at 5500 Å by means of sputtering. Then, using photolithography the pattern is formed to produce the heat activating portion 2008 of 20 $\mu$m×30 $\mu$m after removing the Al film. After that, the insulator formed by SiN is produced as the protection film 2006 in the film thickness of 1 $\mu$m by means of plasma CVD. Then, as the anti-cavitation layer 2007, the Ta film is formed at 2300 Å by means of sputtering. Thus, as shown in FIG. 1, the ink jet substrate of the present invention is produced by means of photolithography.

SST test is carried out by use of the substrate thus produced. The SST test is to obtain the initial foaming voltage for starting discharge by giving the pulse signal whose driving frequency is 10 kHz and driving width is 5 $\mu$sec. After that, the voltage is applied until each of the $1\times10^5$ pulses is broken, while it is being increased per 0.05 V at the driving frequency of 10 kHz. The breaking voltage Vb is obtained when the wiring is broken. The ratio between the initial foaming voltage Vth and the breaking voltage Vb is called the ratio of braking voltage Kb (=Vb/Vth). It is indicated that the larger this ratio of braking voltage Kb, the better the heat resistance of the heat generating member. As the result of the evaluation, the Kb=1.8 is obtained. Such results are shown in Table 1 described above.

Figure 7:
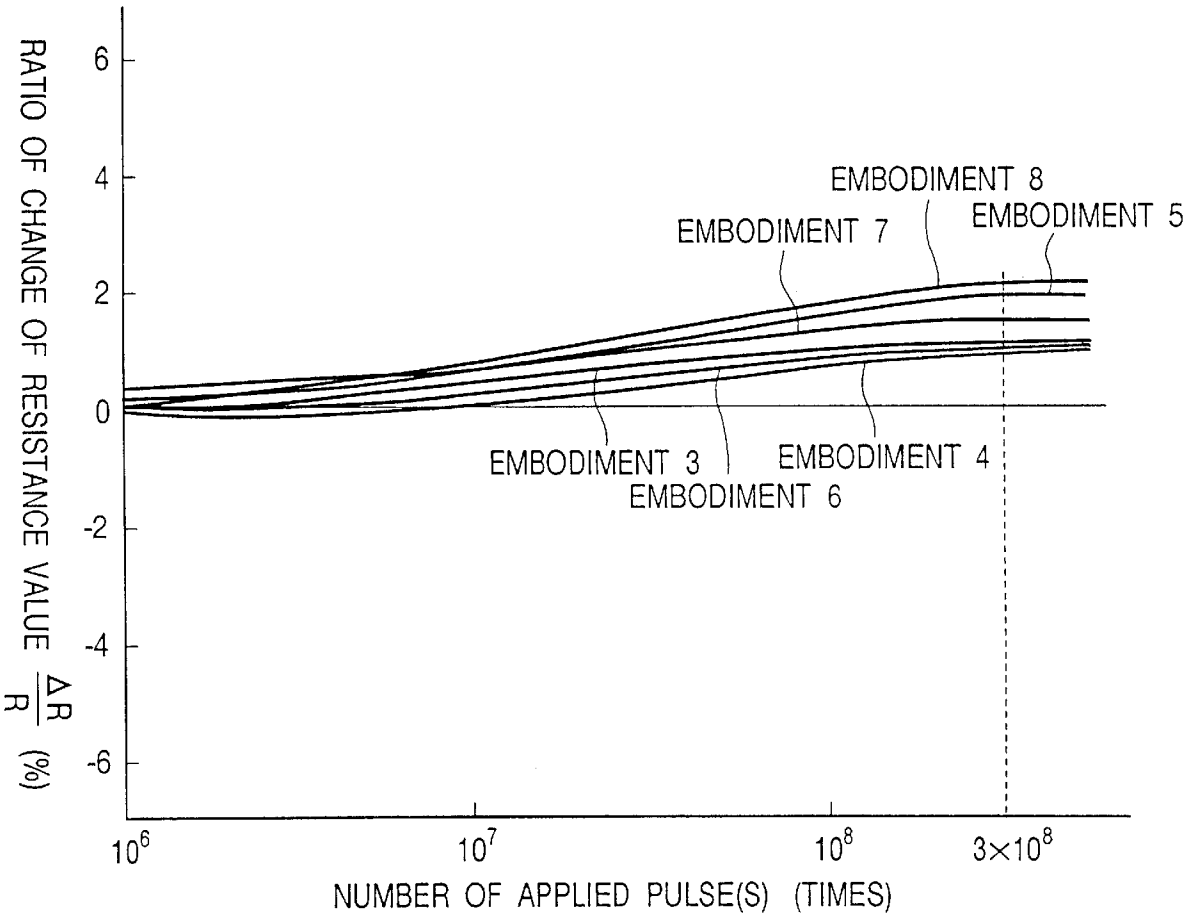
FIG. 7 is a view which shows the results of CST test.

Subsequently, at the driving voltage Vop=1.3·Vth, the pulse $3.0\times10^8$ is continuously applied at the driving frequency of 10 kHz, and the driving width of 5 $\mu$sec. Then, given the initial resistance value of the heat generating member as RO, and the resistance value after the application of pulse as R, the changing ratio of the resistance values, (R−RO)/RO, is obtained (CST test). As a result, the changing ratio of resistance values, ΔR/RO=+1.5% (ΔR=R−RO), is obtained. The results thereof are indicated in Table 1 and FIG. 7.

After that, the head of the embodiment 5 is mounted on an ink jet recording apparatus for the printing durability test. This test is carried out by printing on A-4 sized sheets the general print test patterns incorporated in this ink jet recording apparatus. At this juncture, the driving voltage Vop is set at the 1.3·Vth. With a standard document that contains 1,500 words, 10,000 sheets or more can be printed during the printing life. No deterioration is found in the quality of prints. This indicates that the Ta—Si—N heat generating member is excellent in its durability.

(Embodiments 6 to 8)

With the exception of the heat generating resistance layers 2004 being produced under conditions shown in Table 1, the substrates for the ink jet recording head are produced as in the embodiment 5. Also, as in the embodiment 5, the SST test, CST test, and printing durability test are carried out using such substrates, respectively. The results are shown in Table 1.

COMPARATIVE EXAMPLE 2 to 5

With the exception of the heat generating resistance layers 2004 being produced under conditions shown in Table 1, the substrates for the ink jet recording head are produced as in the embodiment 5. In this case, the powers applied to the targets are: for the comparative example 2, Ta-400 W and Si-500 W; for the comparative example 3, Ta-400 W and Si-400 W; for the comparative examples 4 and 5, Ta-400 W, Si-50 to 200 W. Also, using the substrates the SST test, CST test, and printing durability test are carried out as in the embodiment 5. The results are shown in Table 1.

(Embodiments 9 to 11)

With the exception of the heat generating resistance layers 2004 being produced under conditions shown in Table 1, the substrates for the ink jet head are produced as in the embodiment 5. In this respect, each of the heat generating resistance layers 2004 is formed by means of reactive sputtering using the alloy target of Ta80-Si20. In this case, the power applied to the target is set at 500 W. Also, using each of the substrates thus produced, the SST test, CST test, and printing durability test are carried out as in the embodiment 5. The results are shown in Table 1.

From those result, the following becomes clear:

In other words, from the results shown in Table 1, it is clear that the substrates of the embodiments 5 to 11 of the present invention are provided with excellent CST, SST, and printing durability in the wider range of compositions as compared with the substrates of the comparative examples.

Also, it is estimated that since the heat generating resistance layer used for the conventional ink jet recording head as shown in the comparative example 1 has a smaller sheet resistance value, the electric current value increases two to three times the heat generating resistance layer of the present embodiment when it is driven, although not particularly referred to in Table 1.

This increase of the electric current value greatly affects the ink jet recording apparatus that drives a plurality of heat generating resistance layers, and presents a problem in designing the apparatus. Particularly, for the structure that should deal with the higher image quality at higher speed recording, which necessitates the heat generating resistance layers to be formed smaller, the power consumption increases remarkably if the conventional heat generating members are used. For that matter, if the heat generating members of the present invention are used, it is anticipated that energy saving is possible to a considerable extent.

Also, in accordance with the heat generating member of the present invention, it is possible to obtain the specific resistance values that any one of the heat generating members used for the conventional ink jet recording head can provide. Here, as described earlier, there is a close correlation between the specific resistance value and the composition ratio of the materials of the heat generating member. In this connection, therefore, the present inventor et al. have produced Ta—Si—N films containing plural kinds of composition ratios, while giving attention to the composition ratio of the materials of the heat generating member. The composition range of the Ta—Si—N film, in which the preferable values are obtainable as the specific resistance values of the heat generating member of an ink jet recording head, is shown at A in FIG. 8.

Figure 8:
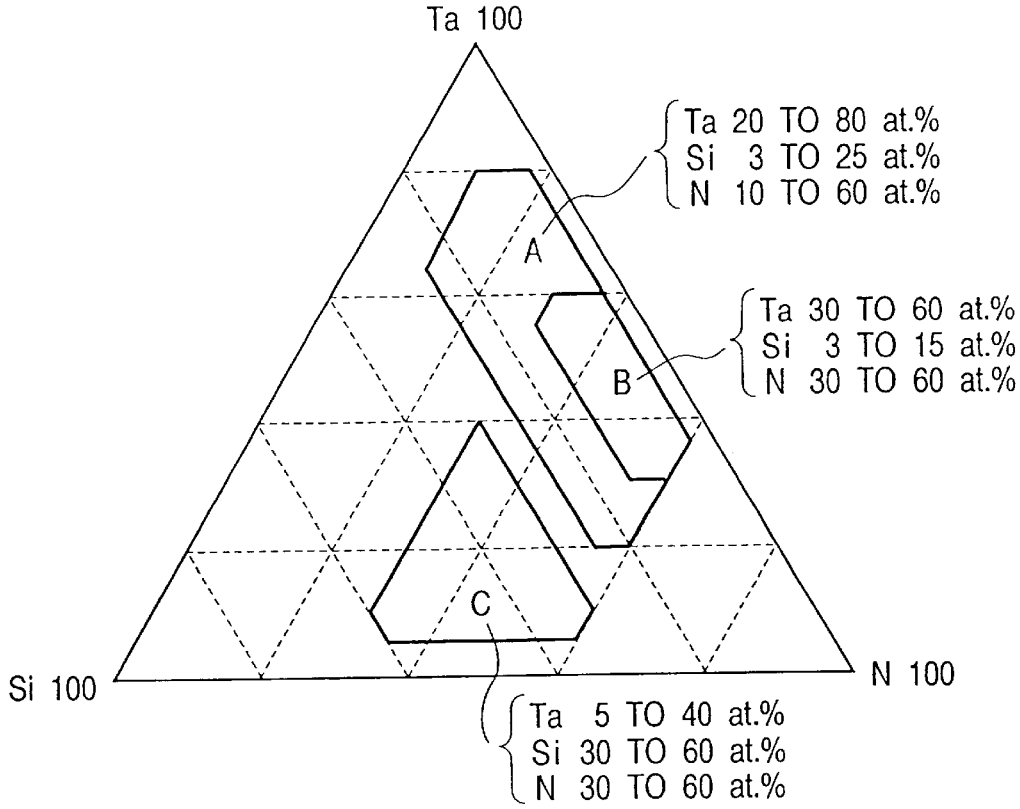
FIG. 8 is a view which shows the range of composition of the resistance member to be used for the heat generating member of an ink jet recording head in accordance with the present invention.

For reference, the composition range, which is considered to be preferable for the thermal printing head disclosed in the specification of Japanese Patent Application Laid-Open No. 53-25442, is shown at C in FIG. 8. The composition ranges of the comparative examples 2, 3, and 5 are within the range shown at C in FIG. 8. The heat generating members that fall within this range present its specific resistance values far beyond 4000 μΩ·cm inevitably. As a result, such heat generating members cannot be used for the ink jet recording head, because wiring is easily broken.

In other words, the temperature coefficient TCR of the resistance of the heat generating member of the present invention presents the negative correlation with the specific resistance value. Therefore, if the specific resistance value becomes larger, it tends to increase in the minus direction, that is, if the TCR is larger, the temperature rises, and at the same time, the resistance value decreases (negative temperature coefficient). On the other hand, it becomes easier for the electric current to flow, which brings about a local increase of temperature on the portion where the current runs, leading to the breakage of wiring. Further, voltage is applied to the heat generating member of the ink jet head in a shorter period of time as compared with the thermal printing head, thus reaching the higher temperature. Therefore, it tends to be affected by TCR more easily, while there is a need for making the TCR as small as possible. Because of this, the specific resistance value of the heat generating member of the present invention is set at 4000 μΩ·cm or less, and more preferably, at 2500 μΩ·cm or less. Here, in the composition range described above, it is known that such specific resistant value becomes larger inevitably if the Ta is smaller than 20 at. %, the Si is more than 25 at. %, or the N is more than 60 at. %. Also, in the composition range described above, if the Ta is more than 80 at. % or the N is less than 10 at. %, the specific resistance value becomes smaller, making it impossible to obtain any heat generating member having a high resistance value aimed at by the invention hereof. Further, it is known that if the Si is less than 3 at. %, the structure of the film is crystalize, and the durability is lowered.

As clear from FIG. 8, the composition range of the present invention, which is shown at A is different from the composition range shown at C, which is used for the thermal printing head, and that the heat generating member has the composition range genuine to the ink jet recording head.

(Embodiments 12 to 17)

Further, the interlayer film 2003 and the protection film 2006 are formed by the materials shown in Table 3, and the substrates for the ink jet head are produced as in the embodiment 3 with the exception of each heat generating resistance layer 2004 being formed under conditions shown in Table 2. The power applied to targets in this case is: Ta-400 W, and Si-150 to 200 W. Using such substrates the SST test, CST test, and printing durability test are carried out as in the embodiment 5. The results are shown in Table 2.

TABLE 2

| | Heat generating resistance layer | Target | Gas flow rate Ar | Gas flow rate N2 | VN2 (%) | Ratio of breaking voltage Kb | Changing ratio of resistance values ΔR/R (%) | Printing durability 10000 shts. 5000 shts | Printing durability 10000 shts. 10000 shts |
|---|---|---|---|---|---|---|---|---|---|
| Embodiment 12 | Ta46-Si6-N48 | Ta, Si | 50.4 | 9.6 | 16 | 1.8 | +1.5 | ○ | ○ |
| Embodiment 13 | Ta38-Si8-N54 | Ta, Si | 46.8 | 13.2 | 22 | 1.8 | +1.6 | ○ | ○ |
| Embodiment 14 | Ta42-Si7-N51 | Ta, Si | 48.9 | 11.1 | 18.5 | 1.8 | +1.3 | ○ | ○ |
| Embodiment 15 | Ta34-Si9-N57 | Ta, Si | 45.3 | 14.7 | 24.5 | 1.7 | +1.8 | ○ | ○ |
| Embodiment 16 | Ta36-Si8.5-N55.5 | Ta, Si | 46.2 | 13.8 | 23 | 1.7 | +2.0 | ○ | ○ |
| Embodiment 17 | Ta58.5-Si3.5-N38 | Ta, Si | 54 | 6 | 10 | 1.8 | +1.8 | ○ | ○ |

Note) ○: good

TABLE 3

| | Interlayer film | Heat generating resistance layer | Protection layer | Specific resistance value ($\mu\Omega \cdot$ cm) |
|---|---|---|---|---|
| Embodiment 12 | SiN | Ta46-Si6-N48 | SiN | 450 |
| Embodiment 13 | SiN | Ta38-Si8-N54 | SiN | 1258 |
| Embodiment 14 | SiN | Ta42-Si7-N51 | SiN | 720 |
| Embodiment 15 | $SiO_2$ | Ta34-Si9-N57 | SiN | 2450 |
| Embodiment 16 | $SiO_2$ | Ta36-Si8.5-N55.5 | $SiO_2$ | 1940 |
| Embodiment 17 | $SiO_2$ | Ta58.5-Si3.5-N38 | $SiO_2$ | 320 |

As in the embodiments 5 to 11 described above, it becomes clear that the embodiments 12 to 17 are also excellent in the CST, SST, and printing durability in the wide composition range. Also, as shown in FIG. 5, the heat generating resistance layer 2004 of the embodiments 12 to 17 has a particularly small amount of Si as compared with the heat generative resistance layer 2004 of the embodiments 5 to 11, and the change of specific resistance values is small with respect to the change of partial pressures of nitrogen. Therefore, the embodiments 12 to 17 are considered to be a preferable method of manufacture for the stabilized production of heat generating resistance layers 2004 having the uniform value of the specific resistance. In this case, the composition range of the Ta—Si—N film is shown at B in FIG. 8. This composition range has the particularly smaller Si amount than that of the composition range shown at A. As described above, the composition range of the present invention shown at B in FIG. 8 is different from the composition range C used for the thermal printing head, which clearly shows that the heat generating members thus produced are genuine to the ink jet recording head.

Also, the substrate of the present invention has a laminated structure comprising the heat accumulation layer/heat generating resistance layer/protection layer having the heat resistance layer formed by at least the Ta—Si—N film between them, and each of the other layers is formed by material having as its structural atom at least one kind of atom of the structural atoms of the heat generating resistance layer described above. As a result, the interlayer contactness is enhanced, and this enhancement is considered to have resulted in such excellent characteristics obtained in the SST test and printing durability test.

Now, hereinafter, the description will be made of the general structure of an ink jet recording apparatus capable of mounting an ink jet recording head of the present invention.

Figure 9:
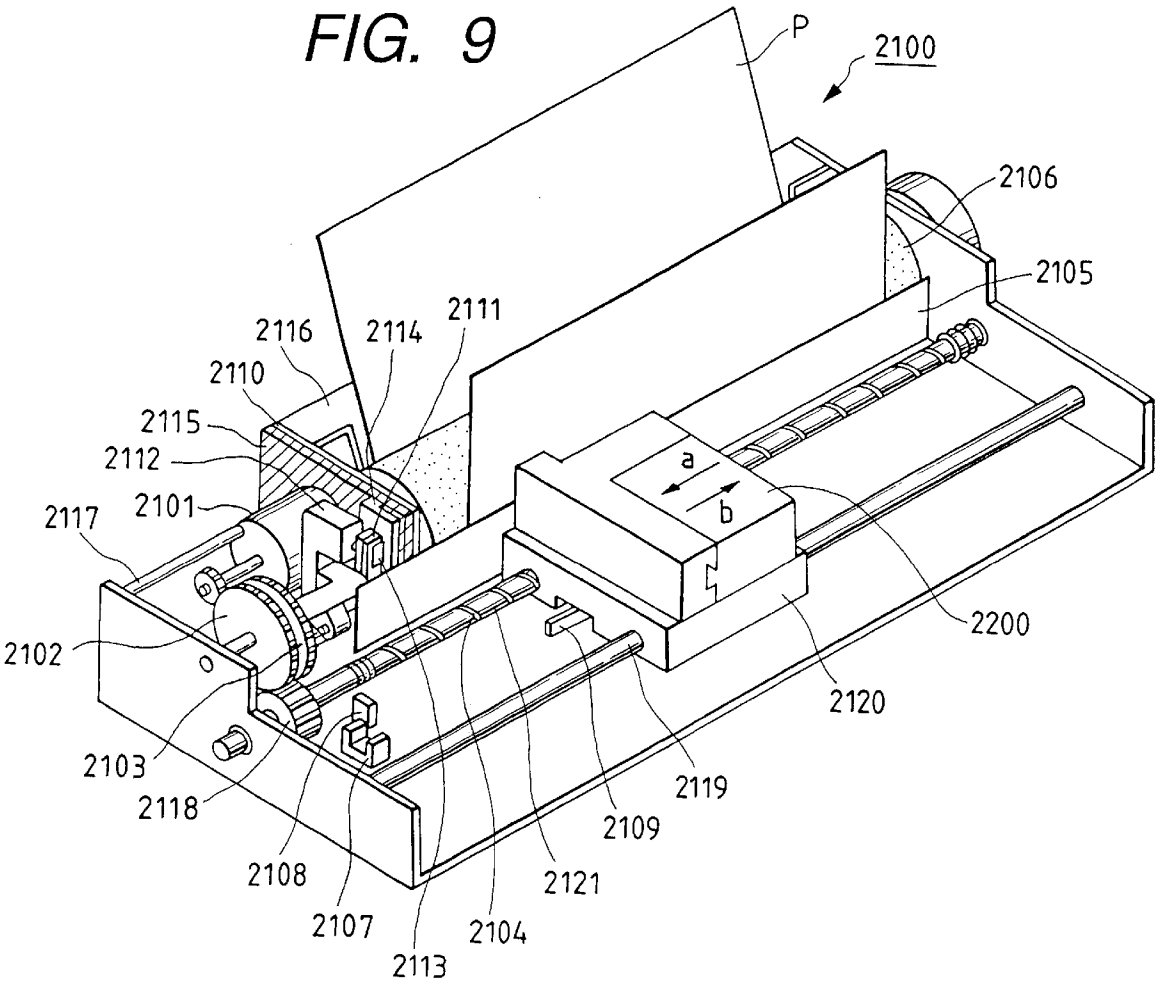
FIG. 9 is a perspective view which schematically shows one example of the ink jet recording apparatus that uses a recording head of the present invention.
Figure 10:
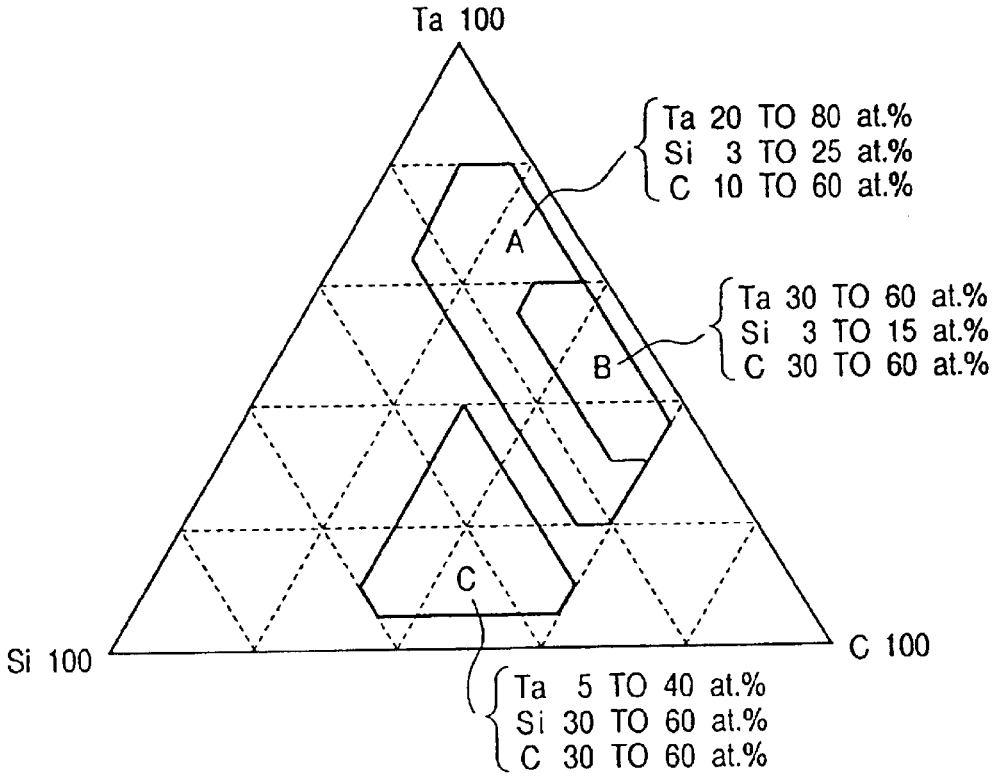
FIG. 10 is a view which shows the range of composition of the Ta—Si—C film to be used for the heat generating member of an ink jet recording head in accordance with the present invention.

FIG. 9 is a perspective view which shows the outer appearance of one example of an ink jet apparatus to which the present invention is applicable. The recording head 2200 is mounted on the carriage 2120, which reciprocates in the directions indicated by arrows a and b together with the carriage 2120 along the guide 2119 by means of the driving power of a driving motor 2101. The carriage 2120 engages with the spiral groove 2121 of the lead screw that rotates through the driving power transmission gears 2102 and 2103 interlocked with the driving motor 2101 that rotates regularly and reversely. The sheet pressure plate 2105, which is used for a recording sheet P to be carried on the platen 2106 by means of a recording medium carrier device (not shown), gives pressure to the recording sheet over the platen 2106 in the traveling direction of the carriage 2120.

Reference numerals 2107 and 2108 designate the photocoupler that serves as home position detecting means for detecting the presence of the lever 2109 of the carriage 2120 within this region in order to switch over the rotational directions of the driving motor 2101; 2110, a member to support the cap member 2111 that caps the entire surface of the recording head 2200; 2112, suction means for sucking liquid from the interior of the cap member, which performs the suction recovery of the recording head 2200 through the aperture 2113 in the cap.

A reference numeral 2114 designates a cleaning blade; 2115, a member to move the blade forward and backward. These are supported by a supporting plate 2116 that supports the main body of the apparatus. The cleaning blade 2114 is not necessarily limited to this mode. The known cleaning blade is of course applicable to this apparatus.

Also, a reference numeral 2117 designates the lever for initiating the suction for the suction recovery, which moves along the movement of the cam 2118 that engages with the carriage 2120. The control of its movement is performed by known transmission means whereby to switch over the driving power from the driving motor 2101 by means of clutch. The recording controller that controls the driving of each mechanism described above is provided for the main body side of the recording apparatus (not shown).

The ink jet recording apparatus 2100 structured as above records on the recording sheet P to be carried on the platen 2106 by means of the recording medium carrier means by causing the recording head 2200 to reciprocate on the entire width of the recording sheet P. Since the recording head 2200 is manufactured by the method described above, it is possible to record highly precise images at high speeds.

As described above, in accordance with the present invention, a plurality of heat generating members, which generate thermal energy utilized for discharging ink, are structured by thin film formed by a material represented by $Ta_x Si_y R_z$ whose specific resistance value is less than 4000 $\mu\Omega\cdot$cm (R: one or more kinds of elements selected from among C, O, N, and x+y+z=100), thus making it possible to use them continuously for a long time with smaller change of resistance values for the provision of high-quality images recorded with long life and reliability.

In accordance with the present invention, it is possible to maintain a desired durability for the heat generating members of an ink jet recording head even when the members are driven by the application of short pulses, hence providing recorded images in high quality for a long time.

The ink jet recording head of the present invention is made possible to provide highly resistive heat generating characteristics for the formation of smaller dots, and when the ink jet recording head is used for recording, it demonstrates high energy efficiency, that is, it can suppress heat generation, hence producing favorable effect on energy saving.

In accordance with a method of the present invention for manufacturing ink jet recording heads, it is possible to produce substrates for use of liquid jet head, as well as liquid jet heads, which are able to demonstrate such effects as described above.

What is claimed is:

1. An ink jet recording head provided with ink discharge openings for discharging ink, a plurality of heat generating members for generating thermal energy for discharging ink, and ink flow paths including said heat generating members therein and communicated with said ink discharge openings, said heat generating members comprising a thin film formed by $Ta_xSi_yC_z$ having a specific resistance value of 4000 $\mu\Omega\cdot$cm or less, where x+y+z=100.

2. An ink jet recording apparatus provided with an ink jet recording head having ink discharge openings for discharging ink, a plurality of heat generating members for generating thermal energy for discharging ink, and ink flow paths including said heat generating members therein and communicated with said ink discharge openings, and carrier means for carrying a recording medium receiving ink discharged from the ink jet recording head, said heat generating members comprising a thin film formed by $Ta_xSi_yC_z$ having a specific resistance value of 4000 $\mu\Omega\cdot$cm or less, where x+y+z=100.

3. An ink jet recording head provided with an ink discharge opening for discharging ink, a heat generating member for generating thermal energy for discharging ink, and an ink flow path including said heat generating member therein and communicated with said ink discharge opening, said heat generating member comprising a thin film formed by $Ta_xSi_yC_z$ having a specific resistance value of 4000 $\mu\Omega\cdot$cm or less, where x+y+z=100.

4. An ink jet recording apparatus provided with an ink jet recording head having an ink discharge opening for discharging ink, a heat generating member for generating thermal energy for discharging ink, and an ink flow path including said heat generating member therein and communicated with said ink discharge opening, and carrier means for carrying a recording medium receiving ink discharged from the ink jet recording head, said heat generating member comprising a thin film formed by $Ta_xSi_yC_z$ having a specific resistance value of 4000 $\mu\Omega\cdot$cm or less, where x+y+z=100.

* * * * *

UNITED STATES PATENT AND TRADEMARK OFFICE

CERTIFICATE OF CORRECTION

PATENT NO. : 6,769,762 B2
DATED : August 3, 2004
INVENTOR(S) : Ichiro Saito et al.

It is certified that error appears in the above-identified patent and that said Letters Patent is hereby corrected as shown below:

Title page,
Item [56], References Cited, OTHER PUBLICATIONS, "Patent Abstracts of Japan, vol. 12, No. 373" reference, "May 28, 1988." should read -- May 28, 1988). --.

Column 1,
Line 45, "is uses" should read -- uses --.

Column 5,
Lines 24, 31, 53 and 64, "head provided" should read -- head is provided --.
Line 40, "apparatus provided" should read -- apparatus is provided --.

Column 8,
Line 56, "exsample" should read -- example --.

Column 9,
Line 13, "voltagex1.3" should read -- voltagex1.3. --.

Column 11,
Line 44, "back scattering)" should read -- Back Scattering) --.

Column 12,
Lines 59 and 60, "braking" should read -- breaking --.

Column 13,
Line 25, "EXAMPLE" should read -- EXAMPLES --.
Line 48, "result," should read -- results. --.

Signed and Sealed this

Twenty-eighth Day of December, 2004

JON W. DUDAS
*Director of the United States Patent and Trademark Office*